US007216778B2

(12) United States Patent
Kaeb

(10) Patent No.: US 7,216,778 B2
(45) Date of Patent: May 15, 2007

(54) SELF-LEVELING DRIP CATCHER FOR FLUID CONTAINERS

(76) Inventor: Todd Kaeb, 170 N. 800 E. Rd., Loda, IL (US) 60948

( * ) Notice: Subject to any disclaimer, the term of this patent is extended or adjusted under 35 U.S.C. 154(b) by 173 days.

(21) Appl. No.: 10/998,456

(22) Filed: Nov. 29, 2004

(65) Prior Publication Data

US 2006/0113321 A1 Jun. 1, 2006

(51) Int. Cl.
*B67D 1/16* (2006.01)
*D06F 39/08* (2006.01)

(52) U.S. Cl. ..... 222/108; 137/312

(58) Field of Classification Search ..... 222/108, 222/556, 566, 571; 137/312, 313, 314; 141/86, 141/87

See application file for complete search history.

(56) References Cited

U.S. PATENT DOCUMENTS 5,470,011 A * 11/1995 Jordan ..... 222/108
5,690,138 A * 11/1997 Fuller ..... 137/312
5,960,995 A * 10/1999 Leatherman et al. ..... 222/108
6,279,781 B1 * 8/2001 Konar ..... 222/108
6,367,670 B1 * 4/2002 Warner et al. ..... 222/556
6,565,899 B1 * 5/2003 Cecere ..... 426/85
6,827,243 B1 * 12/2004 Nuzzolese ..... 222/628

* cited by examiner

*Primary Examiner*—Anh T. N. Vo
(74) *Attorney, Agent, or Firm*—Knechtel, Demeur & Samlan

(57) ABSTRACT

A self-leveling drip catcher for fluid containers. The apparatus comprises an elongated neck and a fluid containment portion at the bottom of the neck. An opening is provided in the top of the neck to releasably attach the apparatus to the fluid container. The fluid containment portion is designed to catch the fluid dispensed from the fluid container which is not received in a drinking receptacle. The fluid is received by the fluid containment portion and is collected therein. The apparatus provides a center of gravity for maintaining a level and balanced equilibrium and substantially vertical orientation when fluid is received into the fluid containment portion.

20 Claims, 4 Drawing Sheets

SELF-LEVELING DRIP CATCHER FOR FLUID CONTAINERS

I. FIELD OF THE INVENTION

The present invention relates to drip catchers and, more particularly, to a device that is designed to self level as it catches or receives excess water or other fluid unintentionally dispensed from the nozzle of a fluid container when the fluid container is not in use or not received into an intended drinking receptacle.

II. DESCRIPTION OF THE PRIOR ART

Water coolers and similar drink dispensers have been around for many years. Of the various sizes and shapes available, the typical water cooler provides a reservoir for containing purified or distilled water or other fluid and a nozzle for dispensing this fluid from the reservoir into a glass, plastic cup, or any other type of receptacle for drinking. The nozzle provided in these water coolers or fluid containers utilizes a lever that may be articulated between an open position to release the fluid from the reservoir through the nozzle and into the drinking receptacle and a closed position to stop the flow of fluid through the nozzle.

The problem with these types of nozzles is that, after the water cooler or drink dispenser has dispensed water or fluid through the nozzle and the nozzle is articulated back to the closed position, the water or fluid that remains in the nozzle continues to flow or drip out of the nozzle. If the drinking receptacle has already been removed, this excess water or fluid will fall on the floor at the base of the water cooler or fluid dispenser. As this excess water or fluid accumulates, a pool of water/fluid is created which presents a hazardous walking condition that may ultimately cause injury to those persons that pass by or use the water cooler or fluid container who slip or fall on the substance. Additionally, this pool of water/fluid may be caused by the drinking receptacle being filled to high with the excess water/fluid overflowing out of the drinking receptacle and/or the nozzle being accidentally articulated thereby dispensing water/fluid directly onto the floor.

Some water coolers have drains or drip catchers built into the water cooler. Applicant's invention is designed to be attached to those water coolers or fluid dispensers not having a built in drain or drip catcher.

Thus, there is a need and there has never been disclosed Applicant's unique self-leveling drip catcher for water coolers or fluid containers.

III. OBJECTS OF THE INVENTION

It is the primary object of the present invention to provide a drip catcher device for water or other fluid dispensers. A related object of the present invention is to provide a drip catcher device that receives or catches any excess water that flows out of or drips from the water cooler which is not received into a drinking receptacle.

Another object of the present invention is to provide a drip catcher that is designed to self level as it fills with water. A related object of the invention is to provide a drip catcher that is stabilized about a center of gravity position for maintaining a substantially fixed position relative to the water cooler and independent of the volume of water or fluid received therein.

Another object of the present invention is to provide a drip catcher device that is designed to be attached to the water cooler or fluid dispenser. A related object of the present invention is to provide a drip catcher device that freely hangs or is suspended from the water cooler or fluid dispenser.

Still another object of the invention is to provide a drip catcher device that is safe and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is an apparatus for providing a self-leveling drip catcher for water coolers or fluid dispensers. Throughout this application, the term fluid container is meant to embrace all water coolers, drink and fluid dispensers having a reservoir with the water or fluid contained therein and dispensed through a nozzle or spigot.

The apparatus comprises an elongated neck and a mouth attached to the neck. A collar is provided in the neck to releasably attach the apparatus to the fluid container. The mouth is designed to catch the fluid dispensed from the fluid container which is not received in a drinking receptacle. The fluid flows into the mouth and is directed to and collected in the bottom. The apparatus' center of gravity maintains the apparatus in a level orientation as the fluid fills the apparatus.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
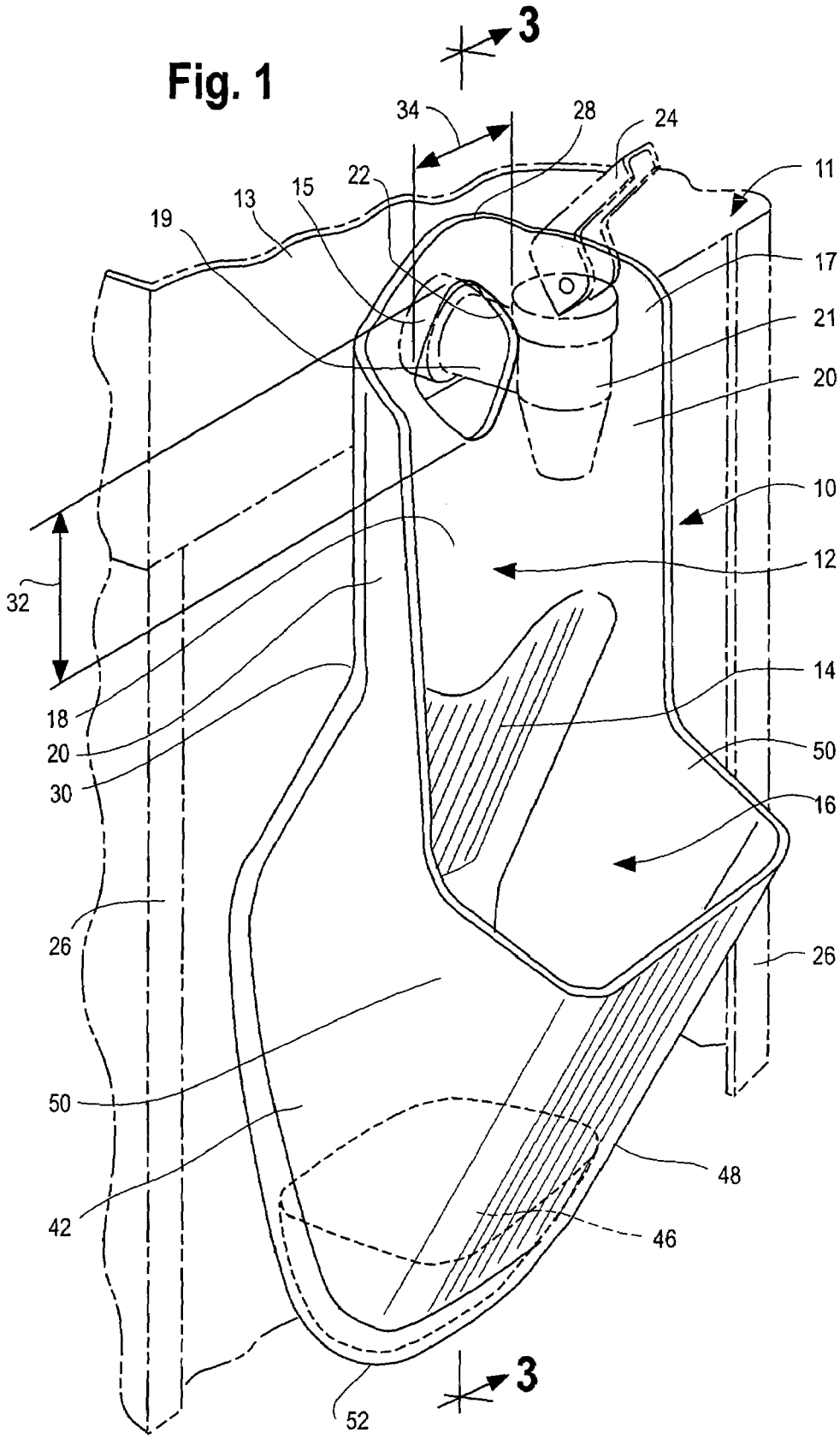
FIG. 1 is a left corner perspective view of Applicant's drip catcher device as attached to a water cooler and having received water or fluid therein.

Turning first to FIG. 1, there is illustrated a drip catcher apparatus 10 suspended from a fluid container 11. As illustrated and in a non-limiting example, the fluid container 11 is provided with a reservoir 13 and a tube 15 extending outwardly from the reservoir 13. A nozzle 17 comprising an arm 19, a projecting spout 21, and an articulating lever 24 is provided. The arm 19 of the nozzle 17 is received into the tube 15 for attaching the nozzle 17 to the reservoir 13 and thereby permitting the means for dispensing water or fluid from the fluid container 11. In a closed position, the nozzle 17 acts as a valve by prohibiting the flow of water or fluid from the fluid container 11. When the nozzle 17 is articulated to an open position, the nozzle 17 acts as a conduit by permitting the unrestricted flow of water or fluid to pass from the fluid container 11 through the nozzle 17 and thereby exit the fluid container 11. The fluid container 11 is also supported by legs 26. This fluid container 11 is known to persons skilled in the art and the information provided herein is for informational purposes only to facilitate a better understanding of Applicant's invention.

Applicant's drip catcher apparatus 10 comprises an elongated neck 12, shoulder 14, and a mouth 16. In the preferred embodiment, the drip catcher apparatus 10 is made of a durable plastic material. Alternatively, the drip catcher apparatus 10 may be made of any other type of material provided that the material is impermeable to water or fluid and of sufficient strength to suspend the device and retain the water or fluid received without cracking or breaking.

Figure 2:
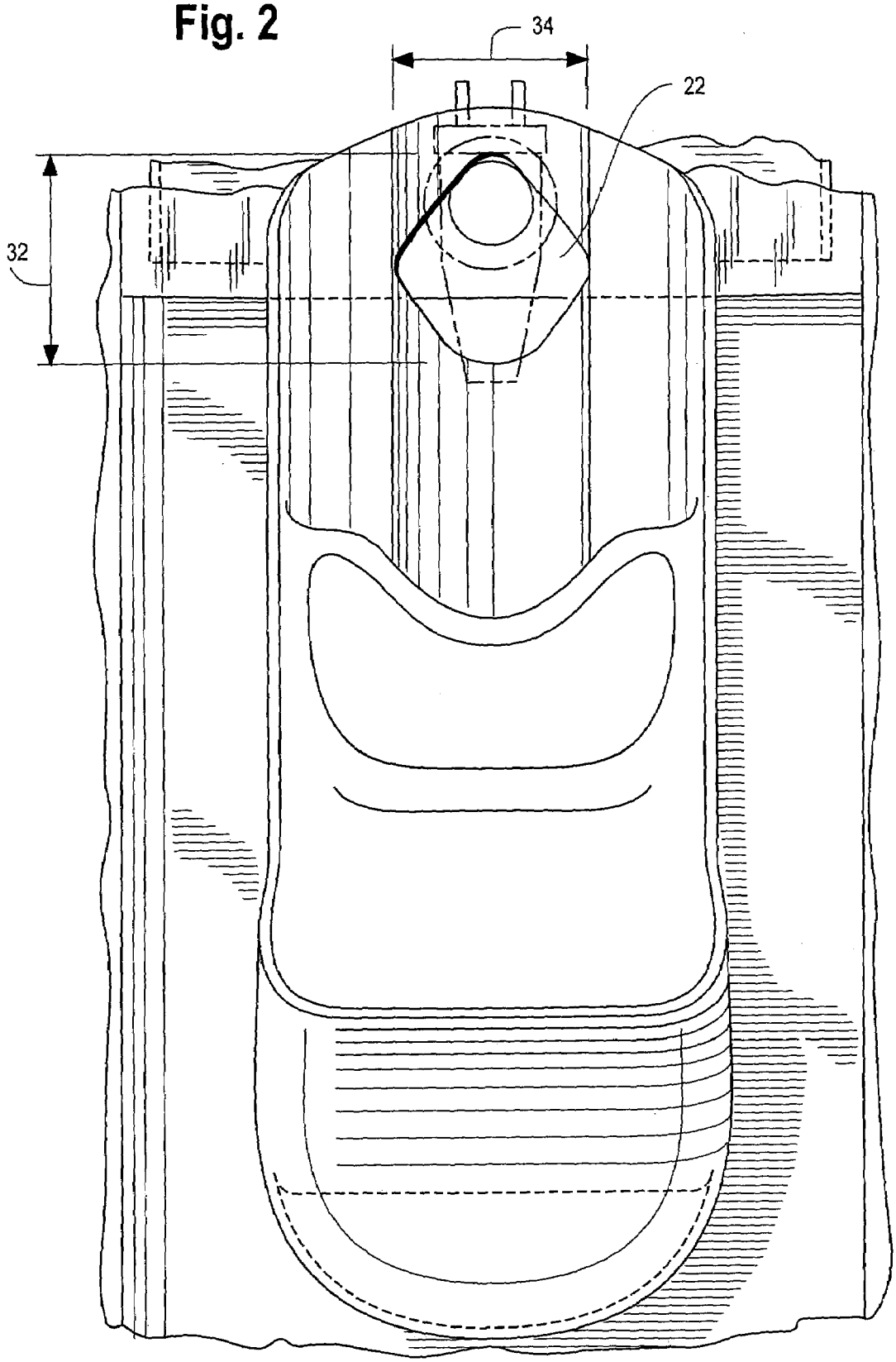
FIG. 2 is front view of the drip catcher device.

The neck 12 has a base wall 18 and sidewalls 20 separated by a proximal end 28 and distal end 30. Integrally formed within the base wall 18 at the proximal end 28 of the neck 12 is a collar 22. The collar 22 is preferably an ovid shape, as illustrated in FIGS. 1 and 2, having a collar height 32 and a collar width 34. In the preferred embodiment, the collar height 32 and collar width 34 (FIG. 2) coact to provide an aperture within the base wall 18 which has dimensions large enough to receive the nozzle 17 or such that the collar 22 may be manipulated in some easy manner to slide it over the nozzle 17. Once slidably received over the nozzle 17 the collar 22 hangs from the tube 17 or arm 19 thereby enabling the drip catcher apparatus 10 to be freely suspended from the fluid container 11 in a vertical position due to the normal gravitational pull on the drip catcher apparatus 10. This is further illustrated in FIG. 3. Alternatively, it is contemplated that any other means for attaching the drip catcher apparatus 10 may be used provided that the neck 12 of the drip catcher apparatus 10 is capable of supporting the weight of both the drip catcher apparatus 10 and the water or fluid received in the apparatus 10 from the fluid container 11.

Figure 3:
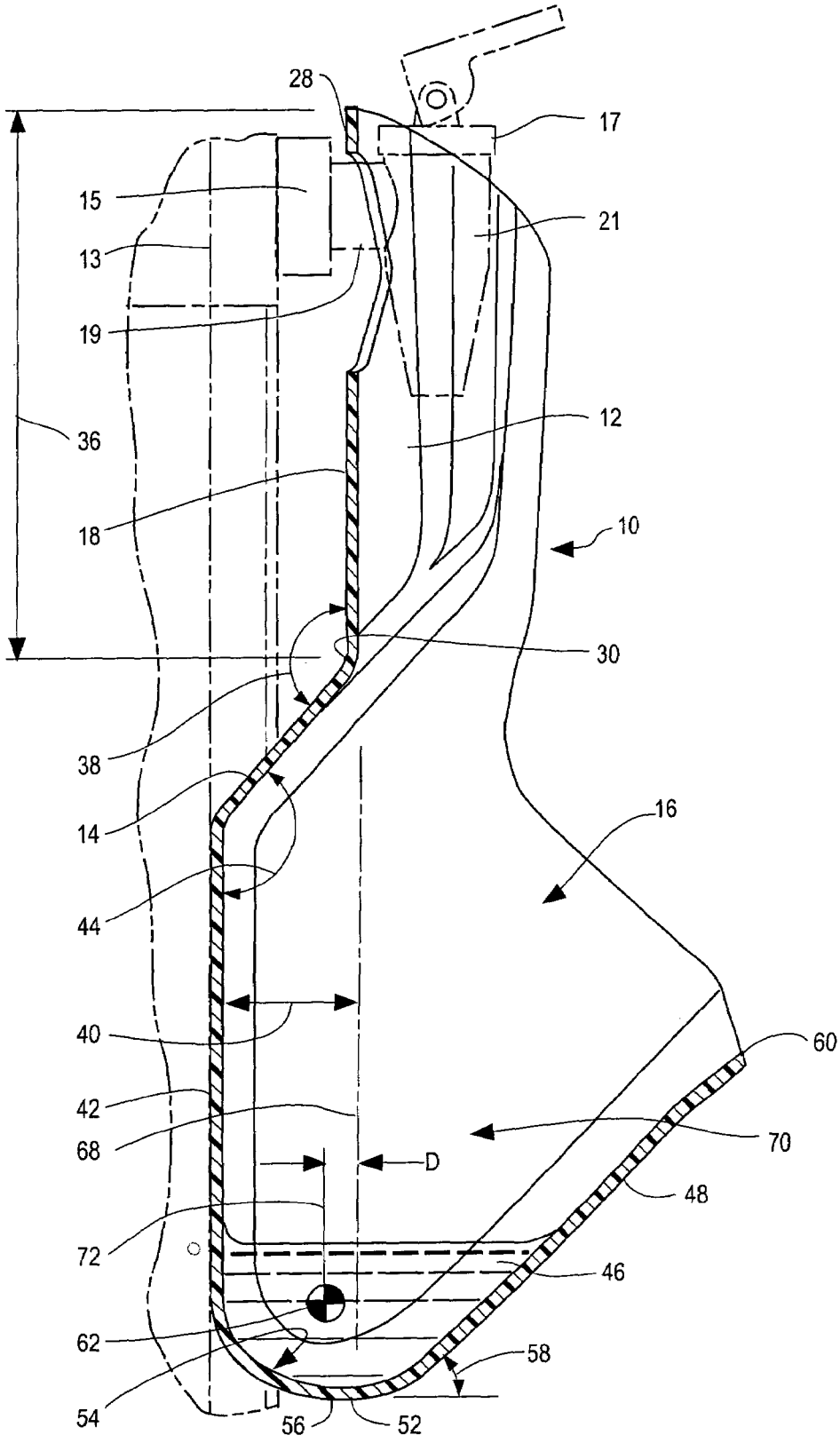
FIG. 3 is a side view of the drip catcher device and, in particular, illustrating the center of gravity point for the device in relation to the contour of the device and water received therein.

The base wall 18 of the neck 12, as illustrated in FIG. 3, is preferably positioned in a parallel relationship to the front of the reservoir 13 and perpendicular to the center axis of the tube 15 or arm 19. In this manner, the drip catcher apparatus 10 is suspended from the tube 15 of the reservoir 13 or the arm 19 and remains separate and apart from and does not otherwise interfere with or engage the fluid container 11. The base wall 18 defines a center line 68 which extends into a fluid containment portion 70. The neck 12 has a neck length 36. In the preferred embodiment, the neck length 36 is approximately eight inches (8"). Alternatively, the neck length 36 may be longer or shorter depending upon the size of the fluid container 11.

At the distal end 30 of the neck 12, the neck 12 rotates through a neck angle 38 to the shoulder 14. The shoulder 14 then continues to extend outwardly from the neck 12 along angle 38 for a total distance 40 until it reaches a back wall 42. In the preferred embodiment, the neck angle 38 is substantially between ninety degrees (90°) and one hundred seventy-five degrees (175°) and the distance 40 is preferably between one inch (1") and one and one-quarter of an inch (1¼"). When the shoulder 14 reaches the back wall 42, the shoulder 14 rotates through a shoulder angle 44 to the back wall 42. In the preferred embodiment, the shoulder angle 44 is equal to neck angle 38. Preferably, the back wall 42 extends downward in a substantially in a vertical plane. Alternatively, the shoulder angle 44 may be greater or lesser than the neck angle 38 or any angle greater than ninety degrees (90°) provided that the shoulder angle 44 results in the back wall 42 extending downwardly in a substantially in a vertical plane.

Referring back to FIG. 1, the drip catcher apparatus 10 catches or receives water or other fluid 46 that is dispensed from the projecting sprout 21 of the nozzle 17 from the fluid container 11 and into the mouth 16. The mouth 16 is defined by the back wall 42, front wall 48, mouth sides 50, and a bottom 52 which essentially forms a type of pocket or essentially concave member to receive and collect the fluid 46.

The mouth 16 is further illustrated in FIG. 3. When the back wall 42 reaches the bottom 52, the back wall 42 rotates through an arc 54 to the bottom 52. The bottom 52 continues with the arc 54 until it reaches a cusp 56. At the cusp 56, the bottom 52 rotates through a bottom angle 58 to the front wall 48. The front wall 48 continues along bottom angle 58 until it reaches a lip 60 at the opening of the mouth 16.

In combination, drip catcher apparatus 10, based upon the configuration of the neck 12, the shoulder 14, the back wall 42, the bottom 52, mouth sides 50, and the front wall 48, has a center of gravity 62. In the preferred embodiment, the center of gravity 62 is located a distance D behind the neck 12. Preferably, the distance D is substantially one-half of an inch (½"). In the preferred embodiment, water or fluid 46 passing through the nozzle 17 and dispensed from the projecting spout 21 will be directed toward and engage the front wall 48 within the mouth 16. Once engaged, the water or fluid 46 will be directed by the front wall 48 downward and into the bottom 52 of the mouth 16 and toward the back wall 42. As a result, all of the volume of fluid 46 received into the mouth 16 is directed to and collected in the bottom 52 between the back wall 42, mouth sides 50, and front wall 48. As more fluid 46 is received into the mouth 16, the fluid volume will rise in the apparatus 10. Based on the design configuration of the apparatus 10 and the fluid containment portion 70, the center of gravity 62 is maintained between the center line 68 and line 72 which defines the distance D. Due to the position of the center of gravity 62, the drip catcher apparatus 10 receives the fluid 46 and continues to remain level. As a result, the drip catcher apparatus 10 maintains a balanced equilibrium which is in a substantially vertical position due to the equal distribution of the fluid 46 on both sides of the center line 68 within the drip catcher apparatus 10 as the total volume of fluid 46 in the fluid containment portion 70 is increased.

Figure 4:
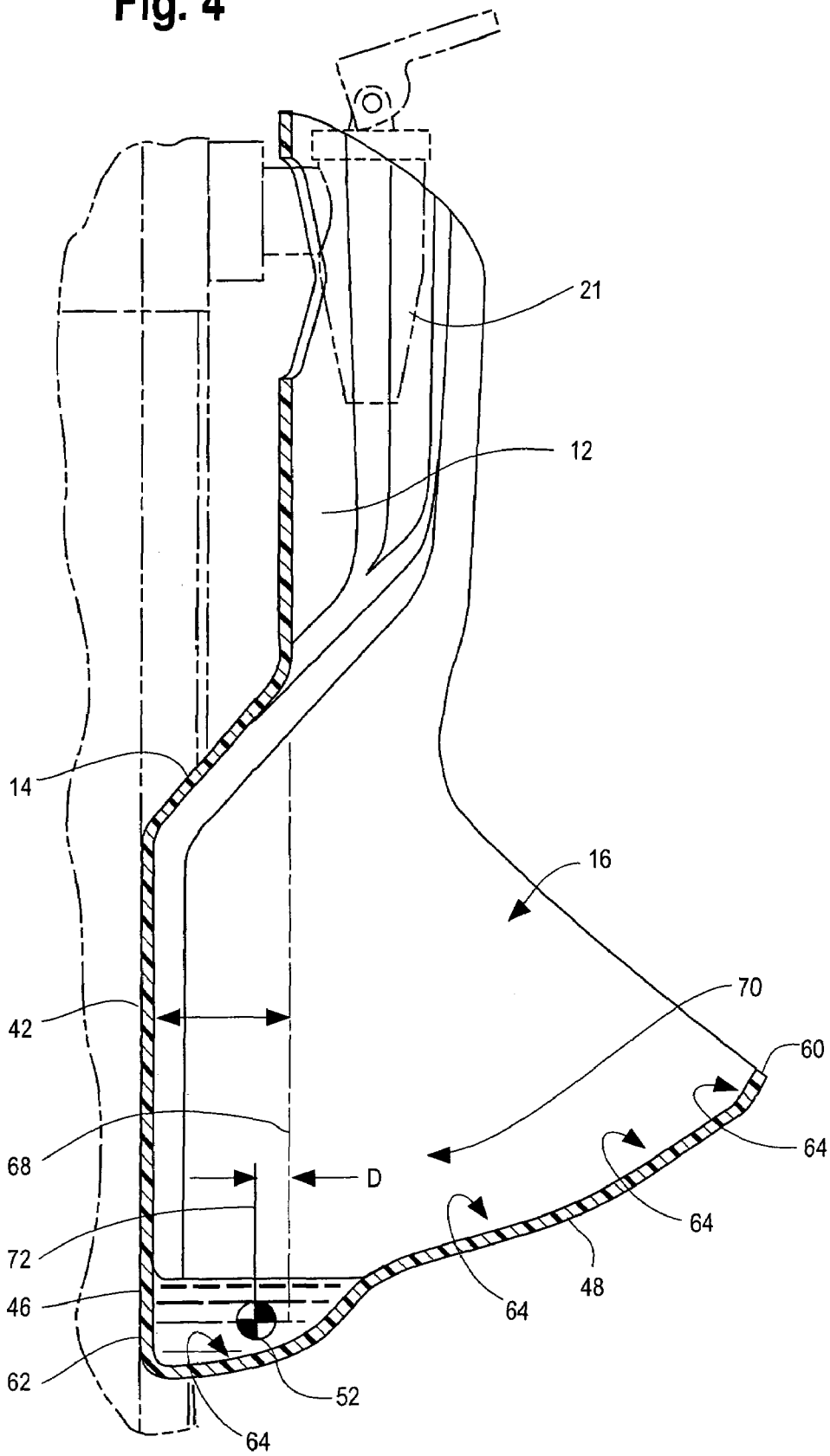
FIG. 4 is a side view of an alternative embodiment of Applicant's drip catcher device.

An alternate embodiment of the present invention is illustrated in FIG. 4. This alternate embodiment is the same as the original embodiment with the exception of the bottom 52 and front wall 48. In this alternate embodiment, the bottom 52 extends outwardly and upwardly from the back wall 42 until it reaches the front wall 48. The front wall 48 likewise continues outwardly and upwardly from the back wall 42 until it reaches the lip 60. In combination, the bottom 52 and the front wall 48 form a single and continuous wall having multiple tiers 64. In use, each of the tiers 64 act to catch the fluid 46 dispensed from the projecting spout 21 and then redirect this fluid 46 toward the bottom 52 to be collected as described herein. In this configuration, the center of gravity 62 remains substantially in the same location between the center line 68 and the line 72 which defines the distance D behind the neck 12. This alternate embodiment also maintains a balanced equilibrium which causes the apparatus 10 to remain in a substantially vertical position due to the equal distribution of the fluid 46 within the drip catcher apparatus 10 as the total volume of fluid 46 received is increased.

Thus, there has been provided a self-leveling drip catcher for fluid containers. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A removable attachment device for receiving a fluid from a fluid container having a reservoir and a nozzle, the device providing a center of gravity for self-leveling the device when receiving the fluid dispensed from the reservoir and through the nozzle of the fluid container, the device comprising:

an elongated member having a front surface and a back surface and a proximal end and a distal end, the elongated member lying in a vertical plane, the reservoir positioned adjacent to the back surface of the elongated member and the nozzle positioned adjacent to the front surface of the elongated member;

a fluid containment portion having an open top, a front wall, a back wall, and a bottom, the back wall located behind the back surface of the elongated member and aligned below the reservoir;

the fluid containment portion integrally formed with the distal end of the elongated member;

means for releasably attaching the elongated member to the fluid container; and the center of gravity located and remaining on or between the back surface of the elongated member and the back wall for stabilizing the device in a substantially vertical orientation as fluid dispensed from the fluid container is received into the open top and collected in the fluid containment portion.

2. The device of claim 1 wherein the fluid containment portion is integrally formed with the distal end of the elongated member by an extension.

3. The device of claim 2 wherein the extension is attached to the distal end of the elongated member and is attached to the back wall of the fluid containment portion.

4. The device of claim 3 wherein the extension is attached to the elongated member at a first angle and is attached to the back wall of the fluid containment portion at a second angle.

5. The device of claim 4 wherein the first angle is an obtuse angle.

6. The device of claim 4 wherein the second angle is substantially equal to the first angle.

7. The device of claim 4 wherein the second angle is an acute angle.

8. The device of claim 1 wherein the center of gravity is located a distance from the vertical plane in the direction toward the back wall of the fluid containment portion.

9. The device of claim 8 wherein the distance is substantially one-half of an inch.

10. The device of claim 1 and further comprising a tubular member connecting to the reservoir of the fluid container and wherein the means for releasably attaching the top portion to the fluid container is an opening situated between the front surface and the back surface of the elongated member.

11. The device of claim 10 wherein the opening is located adjacent to the proximal end of the elongated member.

12. The device of claim 11 wherein the opening has a top portion that rests on the tubular member at a pivot point with the device being free to rotate about the pivot point.

13. A device for receiving a fluid from a fluid container having a reservoir and a nozzle, the device providing a center of gravity for self-leveling the device when receiving the fluid dispensed from the reservoir and through the nozzle of the fluid container, the device comprising:

a back wall having an upper portion and a lower portion each portion having a front side and a back side, the reservoir positioned adjacent to the back side of the upper portion and the nozzle positioned adjacent to the front side of the upper portion, the upper portion lying in a first vertical plane, the lower portion located behind the back side of the upper portion and aligned below the reservoir;

a fluid containment portion disposed on the front side of the lower portion, the fluid containment portion having an open top, a bottom, a front wall, opposed sides, and a back, the back formed by the front side of the lower portion, the first vertical plane passing through the fluid containment portion;

the center of gravity located and remaining on or between the first vertical plane and the second vertical plane for stabilizing the device in a substantially vertical orientation as fluid dispensed from the fluid container is received into the open top and collected into the fluid containment portion; and means for releasably attaching the device to the fluid container.

14. The device of claim 13 wherein the bottom of the fluid containment portion is disposed at an acute angle with respect to the front wall.

15. The device of claim 13 wherein the front wall has a plurality of tiers from the open top to the bottom.

16. The device of claim 13 wherein the first vertical plane is located between the back wall and the front wall of the fluid containment portion.

17. The device of claim 13 wherein the center of gravity is located a distance from the first vertical plane in the direction toward the back of the lower portion.

18. The device of claim 17 wherein the distance is substantially one-half of an inch.

19. The device of claim 13 and further comprising a tubular member connecting the fluid container to the reservoir and wherein the means for releasably attaching the device to the fluid container is an aperture situated within the upper portion of the back wall.

20. The device of claim 19 wherein the aperture has a top portion that rests on the tubular member at a pivot point with the device being free to rotate about the pivot point.

* * * * *